United States Patent [19]

Kobayashi et al.

[11] 4,050,856

[45] Sept. 27, 1977

[54] DASH POT ARRANGEMENT FOR DISTRIBUTION-TYPE FUEL INJECTION PUMP CUT OFF BARREL

[75] Inventors: Masayoshi Kobayashi, Kawagoe; Yasutaka Yuzawa, Kumagaya, both of Japan

[73] Assignee: Diesel Kiki Co., Ltd., Tokyo, Japan

[21] Appl. No.: 665,482

[22] Filed: Mar. 10, 1976

Related U.S. Application Data

[62] Division of Ser. No. 561,530, March 24, 1975, Pat. No. 3,989,021.

[30] Foreign Application Priority Data

| | | |
|---|---|---|
| Mar. 22, 1974 | Japan | 49-31699[U] |
| Mar. 22, 1974 | Japan | 49-31700[U] |
| Mar. 22, 1974 | Japan | 49-31701[U] |

[51] Int. Cl.[2] ..... F04B 49/00; F04B 7/04; F04B 39/10

[52] U.S. Cl. ..... 417/289; 417/499; 123/139 AD

[58] Field of Search ..... 417/498, 499, 500, 289; 123/139 R, 139 AD, 139 BD, 139 E, 139 AR, 139 AE, 139 AZ

[56] References Cited

U.S. PATENT DOCUMENTS

| | | | |
|---|---|---|---|
| 2,011,166 | 8/1935 | Steiner | 417/498 |
| 2,499,706 | 3/1950 | Ward | 123/139 E |
| 3,058,455 | 10/1962 | Hofer et al. | 123/139 BD |
| 3,403,629 | 10/1968 | Eheim et al. | 417/499 |
| 3,777,731 | 12/1973 | Kobayashi et al. | 123/139 BD |
| 3,779,225 | 12/1973 | Watson et al. | 123/139 E |

*Primary Examiner*—Carlton R. Croyle
*Assistant Examiner*—Thomas I. Ross
*Attorney, Agent, or Firm*—Sughrue, Rothwell, Mion, Zinn and Macpeak

[57] ABSTRACT

In one form of the invention, a rotatable and axially slidable plunger mounted within a fixed cylindrical plunger barrel forms with the barrel the casing bore and a spring biased electromagnetically driven axially slidable cut off sleeve, a dash pot chamber including a narrow radial gap between the cut off barrel and the pump casing body. The high pressure cut-off fuel may be directed to the chamber. Alternatively, the cut-off fuel may be directed to impact a deflector to produce an axial force modulating axial shift of the sleeve.

3 Claims, 3 Drawing Figures

DASH POT ARRANGEMENT FOR DISTRIBUTION-TYPE FUEL INJECTION PUMP CUT OFF BARREL

This is a division of application Ser. No. 561,530, filed Mar. 24, 1975, now U.S. Pat. No. 3,989,021.

BACKGROUND OF THE INVENTION

1. Field of the Invention

This invention relates to distribution type fuel injection pumps, and more particularly to such pumps where a spring biased electromagnetically driven, axially slidable cut off sleeve varies the quantity of the individual fuel injection directed to the engine cylinders.

2. Description of the Prior Art

The present invention relates to a distribution type fuel jet pump of the type set forth in U.S. patent application Ser. No. 274,655 filed July 24, 1972, now abandoned.

In such distribution-type fuel injection pumps, a drive shaft rotated by an associated engine causes by way of a rotatable and axially shiftable cam disc, a cylindrical plunger to follow the rotational and reciprocating movement of the cam disc, the plunger being mounted for axial movement and rotation within a fixed plunger barrel. A cylindrical cut off sleeve is slidably and concentrically mounted on the plunger to the side of the fixed plunger barrel opposite that of the cam disc. A cylindrical closure plug is slidably mounted within the cylindrical cut off sleeve and defines a compression chamber between one end of the closure plug and the end of the axially slidable and rotatable plunger which supports the cut off sleeve. The cut off sleeve abuts a fixed cylindrical magnetic core member about which is concentrically mounted a slidable electromagnetic coil which is fixed to the cut off sleeve and drives the sleeve axially against the bias of a compression spring and in a direction tending to reduce the compression chamber formed between the closure end plug and the end of the axially slidable and rotatable plunger. A plurality of radial channels sequentially align with a fuel inlet channel, a fuel outlet channel and a cut off channel respectively, all of which are in communication with the compression chamber 25 by way of a central channel common thereto and extending axially throughout a portion of the plunger. A low pressure pump delivers fuel from a fuel tank compressed to a value corresponding to the rotary speed of the engine to the supply port of the inlet channel. Simultaneously, the cam disc and the plunger are rotated synchronously so that the plunger is imparted with a reciprocating movement corresponding to the lift of the cam face. During the plunger's movement axially back and forth, the suction port comes into registry with the inlet channel of the barrel whereby a portion of the liquid fuel which has reached the supply port is transferred to the compression chamber 25 through the central channel. On further movement of the plunger to reduce the volume of the compression chamber, the radial chamber shifts from a position of alignment with the inlet channel and a second radial channel aligns itself with the outlet channel and the fuel already compressed in the compression chamber is injected under the resulting pressure to one of the cylinders of the engine through a delivery channel. The continued axial shifting of the plunger towards the relatively axially fixed closure end plug continues to reduce the size of the compression chamber until a further radial channel registers with the cut off channel communicating the compression chamber to a low pressure oil sump. This identical action takes place cyclically for as many times as the number of engine cylinders are used for a single rotation of the drive shaft.

Fuel metering is effected by axial shifting of the cut off sleeve which adjusts the timing of the fuel which overflows from the cut off port to the oil sump in relation to the lift of the plunger.

In this respect, an electromagnetic coil acts as a movable solenoid coil which shifts axially back and forth at the same time driving the cut off sleeve, while the closure end plug slides relative to the cut off sleeve maintaining its contact with the fixed core of the assembly. With the coil de-energized, the sleeve is shifted axially to its fullest extent towards the drive shaft and the cam disc. Thus, the axially shiftable and rotatable plunger must shift axially towards the fixed core driven by the cam disc to its minimum extent to align the radial channels and the cut off channel within the cut off sleeve, thus terminating the quantity of fuel injected to the engine and permitting the compressed fuel within the compression chamber to drain to the oil sump. Upon energization of the electromagnetic coil to its maximum extent, the electromagnetic coil and thus the cut off sleeve is shifted in the direction of plunger movement to delay the time at which the cut off channel is aligned with its associated radial channel within the plunger open to the common axial channel, which in turn permits the compression chamber to drain to the sump, thereby increasing the quantity of fuel being injected to the cylinder or cylinders. Effectively, the quantity of fuel injected to the respective cylinders of the engine may be varied electrically in response to electrical signals from various control elements such as an induction coil of a signal generator whose pulse voltage is proportional to the rpm of the engine, electromagnetic detection of the displacement of the accelerator pedal or a feed back signal representive of the axial position of the cut off sleeve.

In such distribution type fuel injection pumps having a plunger barrel within which an axial and rotatable plunger is fitted and which, in turn, supports an axially slidable cut off sleeve which is subjected to the forces of a control spring and electromagnet acting in opposition for decreasing the quantity of the fuel injection and for increasing that quantity respectively, although the cut off sleeve is restored by the force of the spring and by the electromagnet, respectively, depending upon the increase or decrease in the electrical current flowing to the coil which acts to displace the sleeve relative to the core, because of the sliding resistance between the plunger and the cut off sleeve, there is a tendency for the following injection stroke to being prior to the restoration of the sleeve to its original position and as the pressurized fuel is cut off from the pump outlet channel and directed from the compression chamber through the common channel to the fuel pump. For this reason, the position of the cut off sleeve and thus the quantity of the injection fuel for each pulse jet output of the pump becomes unstable regardless of the fact that the electromagnetic force of the coil during ordinary operation remains constant and also that of the displacement of the cut off sleeve as the fuel is injected to each of the cylinders so that the deviation in the quantity of fuel injection to each of the cylinders becomes relatively large.

It is thus an object of the present invention to eliminate the above drawbacks and reduce the amount of axial displacement of the cut off sleeve at the cut off period created by the sliding resistance between the plunger and the cut off sleeve by providing a dash pot chamber between the plunger barrel and the cut off sleeve.

SUMMARY OF THE INVENTION

The present invention is directed to the improvement within such distribution type fuel injection pumps which, in one form comprises a dash pot chamber formed between the plunger barrel and the cut off sleeve and the casing bore for modulating the effect of frictional resistance between the sleeve and the plunger, the plunger in its return movement after pumping tending to carry the sleeve. A ring member may be fixed to the outer periphery of the axially slidable cut off sleeve at the end facing the fixed plunger barrel having an outside diameter which is slightly less than that of the casing bore so as to provide a predetermined radial gap between the ring member and the bore to produce an appropriate dash pot effect on the movement of the cut off sleeve towards the fixed plunger barrel.

In a modified form, the cut-off fuel is directed to the dash-pot chamber to further increase the modulation effect of the chamber on the movement of the sleeve towards the fixed plunger barrel.

In a third form of the invention, the dash-pot or pressure chamber is eliminated and modulation is effected by a deflector which creates an axial force in opposition to the sliding friction between the plunger and the sleeve.

DESCRIPTION OF THE PREFERRED EMBODIMENT

Figure 1:
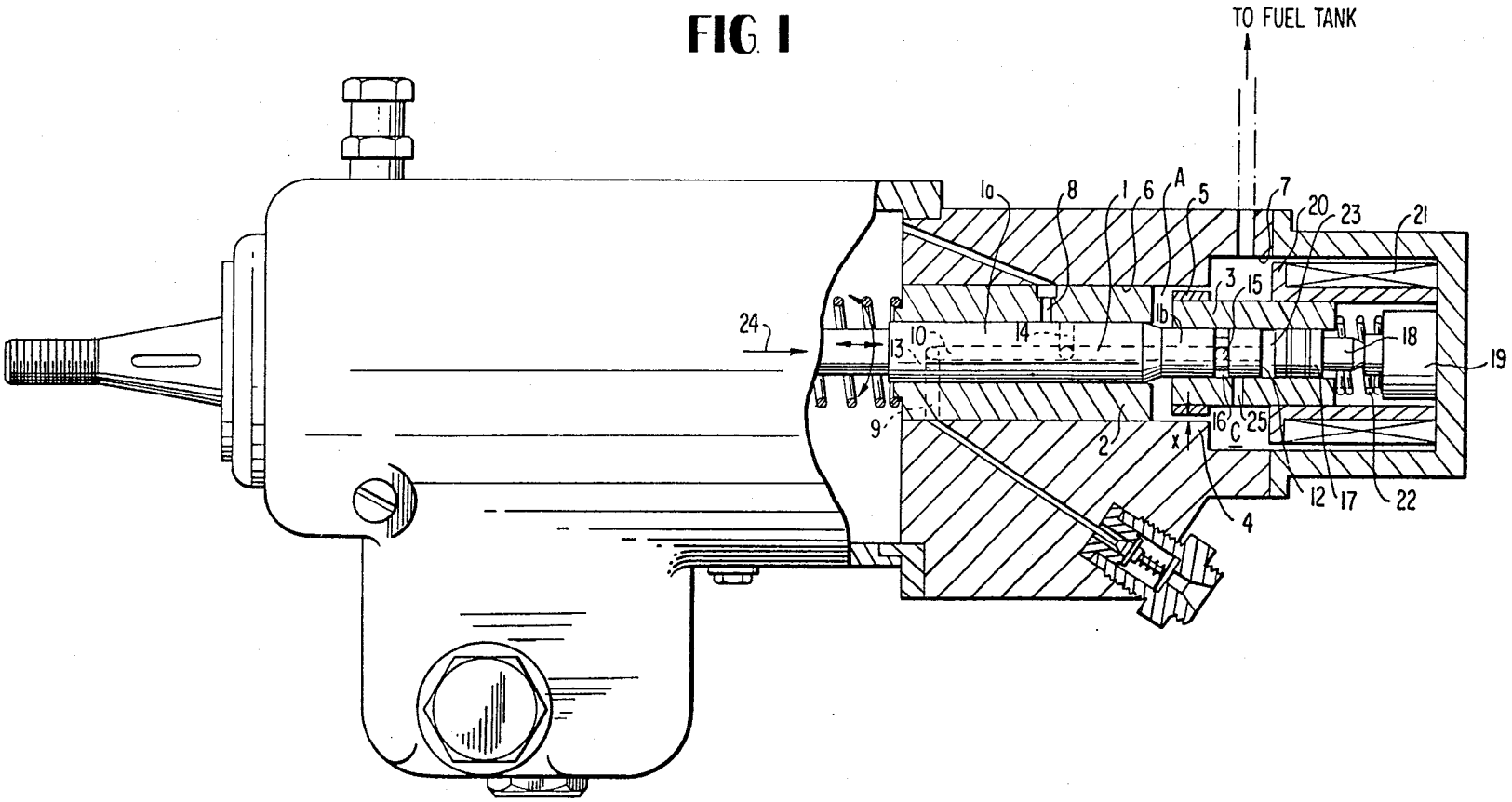
FIG. 1 is a partial sectional view of a distribution type fuel injection pump incorporating a dash pot chamber for the cut off sleeve forming one embodiment of the present invention.

Referring to FIG. 1, one embodiment of the present invention comprises a distribution type fuel injection pump including a casing or pump body 4 provided with a bore 6 and a counterbore 7, the bore 6 receiving a fixed plunger barrel 2 of cylindrical form, both elements being formed of metal, the fixed plunger barrel being provided with a liquid fuel inlet channel 8 and a liquid fuel outlet channel 9 as radial passages therein at axially displaced positions. Slidably mounted within the interior of the fixed plunger barrel 2 is an elongated cylindrical plunger 1 having a large diameter portion 1*a* which is slidably received within the plunger barrel and having a reduced diameter portion 1*b* upon which is slidably mounted in a cylindrical cut off sleeve 3. The plunger 1 is mounted for reciprocating and rotating action as shown by the double headed arrows. Reciprocating and rotating plungers are well known in the prior art. The plunger 1 is further provided with a common axial passage or channel 10 which opens up at the right hand end face 12 of the plunger. The plunger 1 is provided with radial channels 13, 14 and 15 which open up respectively to outlet channel 9, inlet channel 8 and a circumferential groove 16. Slidably mounted within the cut off sleeve 3 is a cylindrical closure end plug 17 provided with a projection 18 on the right hand end of the same which abuts a magnetic block or core 19 fixedly mounted to the end of casing 4 and acting as an abutment for the closure end plug 17. Further, the cut off sleeve 3 has concentrically fixed thereto a bobbin 20 which carries an electromagnetic coil 21. A compression coil spring 22 has its ends compressed between the core 19 and the cut off sleeve so as to bias the cut off sleeve to the left while energization of the electromagnetic coil 21 acts to shift the cut off sleeve to the right with the magnetic flux acting on the fixed core 19 tending to center the coil with respect to that magnetic element. Sufficient space is provided between the outer periphery of the coil 21 and the counter bore 7 with the counter bore, the sleeve and bobbin forming an oil chamber C. A compression chamber 23 is formed between the right hand end face 12 of the plunger 1 and the left hand end face of the closure end plug 17. The arrangement of these elements and the operation of the distribution type fuel injection pump is generally welll known in the prior art. However, in the present invention, in terms of the illustrated embodiment of FIG. 1, bore 6, fixed plunger barrel 2, cut off sleeve 3, and a radially enlarged annular portion or ring 5 at the left hand end of the sleeve 3 form a dash pot chamber A between the plunger barrel 2 and the cut off sleeve 3. While the cut off sleeve 3 is slidably and sealably mounted in concentric fashion about the axially slidable and rotatable plunger 1, the diameter of the ring 5 is such that there is a radial gap $x$ between the bore 6 of the casing or pump body 4 and the ring, such that there is a slow release of fuel oil to chamber C which is caught within the dash pot chamber A during shifting of the cut off sleeve from right to left under the compression force of the spring 22.

Usually the cut off sleeve 3 moves in a direction B in which the quantity of the fuel injection reduces. Since the cut off period is sort, the cut off period being determined by the axial shifting of the plunger 1 from a left to right direction which in turn first aligns the inlet channel 8 with the radial channel 14 of the plunger to deliver liquid fuel to the compression chamber 23, then cutting off this chamber from the inlet channel 8 and thence upon axial alignment of the radial channel 13 of the plunger with the outlet channel 9 of the fixed plunger barrel, liquid fuel is delivered in jet form to a given cylinder of the engine with which the pump is associated. Subsequently, upon continued movement of the plunger in the direction of arrow 24 the third radial passage 15 leading to the common central channel 10, causes a connection between the compression chamber 23 and the cut off channel 25 within the cut off sleeve 3, whereupon, the fuel is diverted to the oil chamber C and returns to the oil sump (not shown) of the pump. Assuming that the biasing force of the compression spring 22 shifts the sleeve 3 to the left in the direction of arrow B, however, depending upon the current flow through the coil 21, the sleeve shifts in the opposite direction to the right against the compression of spring 22, the more the sleeve is shifted to the left, the shorter the injection volume and time before cut off, while the more the sleeve 3 shifts to the right against the bias of the compression spring, the greater the delay in cut off and the greater the volume of fuel being injected to a respective cylinder.

Due to the frictional sliding resistance between the plunger and the cut off sleeve, there is a tendency for the cut off sleeve to move in the direction B in which the quantity of fuel injection is reduced by action of the cut off mechanism, but with the presence of the dash pot chamber A, there is a dampening of the tendency to shift in that direction and thus an increase in stability of the sleeve 3 to be maintained in a particular position, dependent upon the magnitude of the current flow to coil 21.

Thus, according to the present invention, in this embodiment, it is possible to stabilize the quantity of fuel injection at ordinary rpm by reducing the amount of displacement at cut off of the cut off sleeve 3 owing to the dash pot effect without increasing the electromagnetic force necessary to act on the sleeve, so that the diversity of fuel distribution is reduced and a stable electrically controlled fuel injection pump can thus be obtained.

Figure 2:
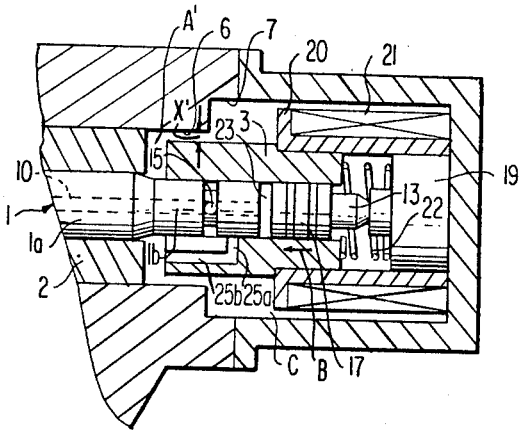
FIG. 2 is a sectional view of a distribution type fuel injection pump incorporating a pressurized dash pot chamber constituting a second embodiment of the present invention.

Referring next to FIG. 2, where like elements carry like numerical designations, it may be seen that in this embodiment the radial channel 25*a* within the cut off sleeve 3 intersects a horizontal channel 25*b* which opens up into the dash pot chamber A', thus at the time of cut off, the fuel within compression chamber 23 diverts from the outlet channel into the dash pot chamber and then by way of the small radial gap *x'* into the oil chamber C and thence to the sump. Thus, the effect of directly communicating the cut off channel 25*a* to 25*b* the dash pot chamber A is to even further reduce the amount of actual displacement of the cut off sleeve by increasing the pressure within the dash pot chamber A', since the connection between the dash pot chamber and the compression chamber 23 occurs only after the end of the cut off sleeve 3 moves under the bore 6 and wherein the dash pot chamber A' is relieved only by way of the narrow gap radial passage *x'* which relieves the dash pot chamber A' by a relatively predetermined small cross sectional area such that the hydraulic force set up by the increased pressure within the dash pot chamber A' acts in opposition to the restoring force in the direction B by way of the relaxation of the compressed coil spring.

Figure 3:
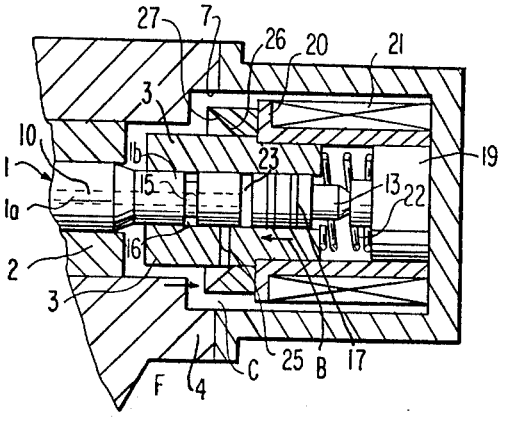
FIG. 3 is a sectonal view of a distribution type fuel injection pump incorporating a deflector for the cut off jet of the reciprocating cut off sleeve forming yet a third embodiment of the present invention.

Referring to FIG. 3, there is shown a third embodiment of the present invention, in which like elements are given like numerical designations. The pump casing or body 4 is provided with a bore 6 and a counter bore 7 and in a similar manner to the prior embodiment, a fixed plunger barrel 2 is mounted within bore 6 and in turn receives an axially slidable and rotatable plunger 1 including a large diameter portion 1*a* within the fixed plunger barrel 2 and a rightwardly projecting small diameter portion 1*b*. That portion 1*b* slidably mounts a cut off sleeve 3 to which is fixed a bobbin 20 carrying electromagnetic coil 21 and slidably mounted within the center of the sleeve 3, at the right hand end is an end plug 17 which forms between itself and the right hand end of the plunger 1, a compression chamber 23. The plunger 1 includes a central common channel 10 which opens up into compression chamber 23 and is provided with a radial channel 15 opening into a circumferential groove 16 which in turn communicates with a radial channel 25 leading directly to the oil chamber C rather than by way of a dash pot chamber as in the prior illustrated embodiment. The operation of this embodiment of the invention is essentially the same as that of the first embodiment with the exception that there is no dash pot action. However, in this case, the axial displacement of the cut off sleeve at the termination of the cut off period is provided by way of an annular ring 26 which forms an oblique deflecting surface 27 at the radially outward or discharge end of the radial channel 25 with the high pressure fluid which enters channel 25 from the compression chamber 23 impacting against the diagonal face 27 of ring 26 causes an axial force F to act on the ring to reduce the tendency of the sleeve 3 to move to the left even though the sliding resistance between the sleeve 3 and the plunger 1 tends to continue such movement prior to restoration of the sleeve to its original position by energization of the electromagnetic coil 21. Thus, the effect of the deflection of the high pressure liquid entering chamber C by impingement upon the oblique or inclined surface 27 is such as to aid the electromagnetic coil 21 in restoring the position of the sleeve 3. At the same time, the return movement of the plunger 1 tends ro cause the sleeve to move in the opposite direction as identified by arrow B, along with the effect of the compression spring 22.

While the invention has been particularly shown and described with reference to preferred embodiments thereof, it wll be understood by those skilled in the art that various changes in form and details may be made therein without departing from the spirit and scope of the invention.

What is clamed is:

1. In a distribution type fuel injection pump having a casing, a bore within said casing, inlet and outlet fuel channels in said casing and bore, a cylindrical plunger barrel fixedly mounted within said bore, an axially slidable and rotatable plunger mounted within said plunger barrel, a cut off sleeve slidably mounted on said slidable and rotatable plunger for relative movement with respect to said plunger and said casing, an end plug slidably and sealably mounted within said sleeve and forming with the end of said plunger a fuel compression chamber, a fixed magnetic core carried by said casing in contact with said end plug and limiting axial movement of said end plug in a direction out of said sleeve, an electromagnetic coil fixed to said sleeve and concentrically surrounding said core and axially movable thereon in a direction away from said plunger barrel in response to energization thereof, means spring biasing said coil and said sleeve in a direction towards said cylinder plunger barrel, a axial channel running from said compression chamber axially through a portion of said plunger, first, second and third radial channels within said plunger intersecting said axial channel and positioned for communicating with said inlet and outlet fuel chambers and for opening up to the periphery of said plunger, respectively, a radial cut off channel within said cut off sleeve and movable to a position and alignable with the third radial channel of said plunger to relieve fuel within said compression chamber at cut off, the improvement comprising: means defining a dash pot chamber between said casing, said plunger barrel and said cut off sleeve for dampening movement of said cut off sleeve towards said plunger barrel.

2. The distribution type fuel injection pump as claimed in claim 1, wherein the outer diameter of said cut off sleeve is substantially less than the bore of said casing, and said sleeve carries a ring concentrically fixed thereto at the end adjacent said fixed plunger barrel having an external diameter slightly smaller than the diameter of said bore so as to restrict the flow of fuel from said dash pot chamber to said oil chamber.

3. The distribution type fuel injection pump as claimed in claim 1, wherein said channel means within said cut off sleeve for connecting said compression chamber to said oil chamber comprises a radial channel leading from the radial channel within said plunger and intersecting a longitudinal channel within said sleeve and opening up onto the end face of said sleeve which faces the end of said fixed plunger barrel and forming with said barrel and said bore, said dash pot chamber.

* * * * *